US008326618B2

(12) United States Patent
Jax et al.

(10) Patent No.: US 8,326,618 B2
(45) Date of Patent: Dec. 4, 2012

(54) METHOD AND APPARATUS FOR LOSSLESS ENCODING OF A SOURCE SIGNAL, USING A LOSSY ENCODED DATA STEAM AND A LOSSLESS EXTENSION DATA STREAM

(75) Inventors: Peter Jax, Hannover (DE); Florian Keiler, Hannover (DE); Oliver Wuebbolt, Hannover (DE); Sven Kordon, Hannover (DE); Johannes Boehm, Goettingen (DE)

(73) Assignee: Thomson Licensing, Boulogne-Billancourt (FR)

( * ) Notice: Subject to any disclaimer, the term of this patent is extended or adjusted under 35 U.S.C. 154(b) by 1050 days.

(21) Appl. No.: 12/227,045

(22) PCT Filed: Apr. 18, 2007

(86) PCT No.: PCT/EP2007/053784

§ 371 (c)(1),
(2), (4) Date: Nov. 5, 2008

(87) PCT Pub. No.: WO2007/128662

PCT Pub. Date: Nov. 15, 2007

(65) Prior Publication Data

US 2009/0177478 A1 Jul. 9, 2009

(30) Foreign Application Priority Data

May 5, 2006 (EP) ..... 06113596

(51) Int. Cl.
*G10L 21/00* (2006.01)

(52) U.S. Cl. ..... 704/229; 704/500; 375/240.24

(58) Field of Classification Search ..... 704/229, 704/500; 375/240.24
See application file for complete search history.

(56) References Cited

U.S. PATENT DOCUMENTS

| | | | | |
|---|---|---|---|---|
| 6,154,484 | A | 11/2000 | Lee et al. | |
| 6,498,811 | B1 | 12/2002 | Van Der Vleuten | |
| 7,275,036 | B2 | 9/2007 | Geiger et al. | |
| 7,454,354 | B2 | 11/2008 | Nomura et al. | |
| 8,086,465 | B2 * | 12/2011 | Malvar | 704/504 |
| 2003/0171919 | A1 | 9/2003 | Kim et al. | |
| 2004/0044520 | A1 * | 3/2004 | Chen et al. | 704/200.1 |
| 2004/0044534 | A1 * | 3/2004 | Chen et al. | 704/501 |

FOREIGN PATENT DOCUMENTS

| | | |
|---|---|---|
| JP | 10105200 | 4/1998 |
| JP | 2004177982 | 6/2004 |
| WO | WO 00/79520 | 12/2000 |
| WO | WO 03/088212 | 10/2003 |
| WO | W02005098822 | 10/2005 |
| WO | W02005098823 | 10/2005 |

OTHER PUBLICATIONS

Kevin Adistambha: "Embedded Lossless Audio Coding using Linear Prediction and Cascade coding" Thesis, University of Wollongong, 2005, pp. 1-89, XP002447409.

(Continued)

*Primary Examiner* — Daniel D Abebe
(74) *Attorney, Agent, or Firm* — Tutunjian & Bitetto, P.C.

(57) ABSTRACT

In lossy based lossless coding a PCM audio signal passes through a lossy encoder to a lossy decoder. The lossy encoder provides a lossy bit stream. The lossy decoder also provides side information that is used to control the coefficients of a prediction filter that de-correlates the difference signal between the PCM signal and the lossy decoder output. The de-correlated difference signal is lossless encoded, providing an extension bit stream. Instead of, or in addition to, de-correlating in the time domain, a de-correlation in the frequency domain using spectral whitening can be performed. The lossy encoded bit stream together with the lossless encoded extension bit stream form a lossless encoded bit-stream. The invention facilitates enhancing a lossy perceptual audio encoding/decoding by an extension that enables mathematically exact reproduction of the original waveform, and provides additional data for reconstructing at decoder site an intermediate-quality audio signal. The lossless extension can be used to extend the widely used mp3 encoding/decoding to lossless encoding/decoding and superior quality mp3 encoding/decoding.

36 Claims, 4 Drawing Sheets

OTHER PUBLICATIONS

C.H. Ritz et al: "Lossless Wideband Speech Coding" Proceedings of the Australian Int'L Conf. of Speech Science and Technology, Dec. 8, 2004, pp. 249-252, XP00239966.

A. Jin et al.: "Scalable audio coder based on quantizer units of MDCT coefficients" IEEE Int'L Conf. on Acoustics, Speech, and Signal Processing. vol. 2, Mar. 15, 1999, pp. 897-900, XP010328465.

Search Report Dated August 21, 2007.

* cited by examiner

METHOD AND APPARATUS FOR LOSSLESS ENCODING OF A SOURCE SIGNAL, USING A LOSSY ENCODED DATA STEAM AND A LOSSLESS EXTENSION DATA STREAM

This application claims the benefit, under 35 U.S.C. §365 of International Application PCT/EP2007/053784, filed Apr. 18, 2007, which was published in accordance with PCT Article 21(2) on Nov. 15, 2007 in English and which claims the benefit of European patent application No. 06113596.8, filed May 5, 2006.

The invention relates to a method and to an apparatus for lossless encoding of a source signal, using a lossy encoded data stream and a lossless extension data stream which together form a lossless encoded data stream for said source signal.

BACKGROUND

In contrast to lossy audio coding techniques (like mp3, AAC etc.), lossless compression algorithms can only exploit redundancies of the original audio signal to reduce the data rate. It is not possible to rely on irrelevancies, as identified by psycho-acoustical models in state-of-the-art lossy audio codecs. Accordingly, the common technical principle of all lossless audio coding schemes is to apply a filter or transform for de-correlation (e.g. a prediction filter or a frequency transform), and then to encode the transformed signal in a lossless manner. The encoded bit stream comprises the parameters of the transform or filter, and the lossless representation of the transformed signal.

See, for example, J. Makhoul, "Linear prediction: A tutorial review", Proceedings of the IEEE, Vol. 63, pp. 561-580, 1975, T. Painter, A. Spanias, "Perceptual coding of digital audio", Proceedings of the IEEE, Vol. 88, No. 4, pp. 451-513, 2000, and M. Hans, R. W. Schafer, "Lossless compression of digital audio", IEEE Signal Processing Magazine, July 2001, pp. 21-32.

Figure 8:
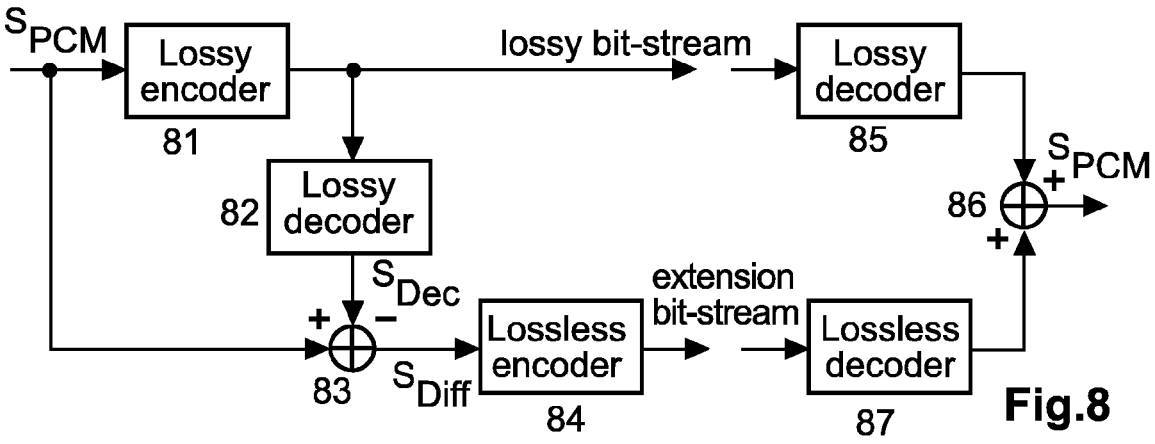
Figure 9:
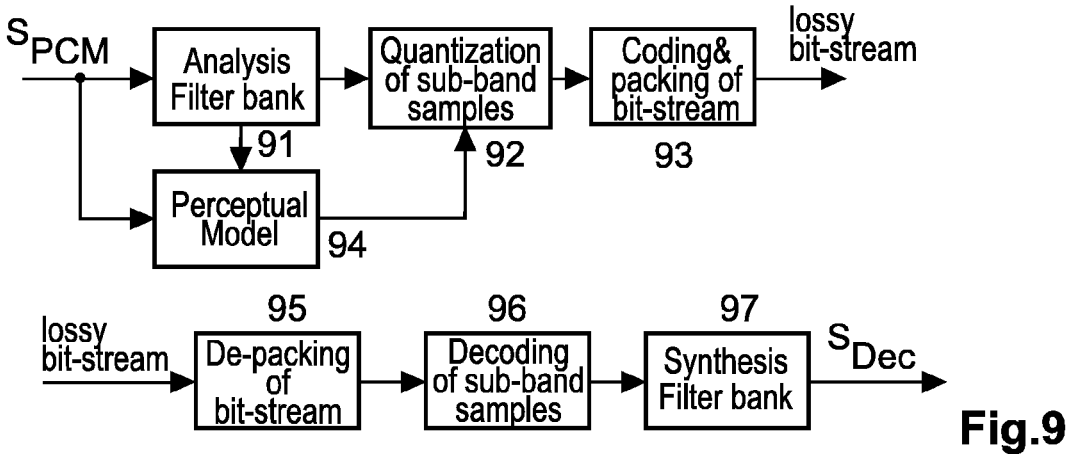

The basic principle of lossy based lossless coding is depicted in FIG. 8 and FIG. 9. In the encoding part on the left side of FIG. 8, a PCM audio input signal $S_{PCM}$ passes through a lossy encoder 81 to a lossy decoder 82 and as a lossy bit stream to a lossy decoder 85 of the decoding part (right side). Lossy encoding and decoding is used to de-correlate the signal. The output signal of decoder 82 is removed from the input signal $S_{PCM}$ in a subtractor 83, and the resulting difference signal passes through a lossless encoder 84 as an extension bit stream to a lossless decoder 87. The output signals of decoders 85 and 87 are combined 86 so as to regain the original signal $S_{PCM}$.

This basic principle is disclosed for audio coding in EP-B-0756386 and US-B-6498811, and is also discussed in P. Craven, M. Gerzon, "Lossless Coding for Audio Discs", J. Audio Eng. Soc., Vol. 44, No. 9, September 1996, and in J. Koller, Th. Sporer, K. H. Brandenburg, "Robust Coding of High Quality Audio Signals", AES 103rd Convention, Preprint 4621, August 1997.

In the lossy encoder in FIG. 9, the PCM audio input signal $S_{PCM}$ passes through an analysis filter bank 91 and a quantization 92 of sub-band samples to a coding and bit stream packing 93. The quantisation is controlled by a perceptual model calculator 94 that receives signal $S_{PCM}$ and corresponding information from the analysis filter bank 91.

At decoder side, the encoded lossy bit stream enters a means 95 for de-packing the bit stream, followed by means 96 for decoding the subband samples and by a synthesis filter bank 97 that outputs the decoded lossy PCM signal $S_{Dec}$.

Examples for lossy encoding and decoding are described in detail in the standard ISO/IEC 11172-3 (MPEG-1 Audio).

In the state of the art, lossless audio coding is pursued based on one of the following three basic signal processing concepts:

a) time domain de-correlation using linear prediction techniques;
b) frequency domain lossless coding using reversible integer analysis-synthesis filter banks;
c) lossless coding of the residual (error signal) of a lossy base layer codec.

INVENTION

A problem to be solved by the invention is to provide hierarchical lossless audio encoding and decoding, which is built on top of an embedded lossy audio codec and which provides a better efficiency (i.e. compression ratio) as compared to state-of-the-art lossy based lossless audio coding schemes.

This invention uses a mathematically lossless encoding and decoding on top of a lossy coding. Mathematically lossless audio compression means audio coding with bit-exact reproduction of the original PCM samples at decoder output. For some embodiments it is assumed that the lossy encoding operates in a transform domain, using e.g. frequency transforms like MDCT or similar filter banks. As an example, the mp3 standard (ISO/IEC 11172-3 Layer 3) will be used for the lossy base layer throughout this description, but the invention can be applied together with other lossy coding schemes (e.g. AAC, MPEG-4 Audio) in a similar manner.

The transmitted or recorded encoded bit stream comprises two parts: the embedded bit stream of the lossy audio codec, and extension data for one or several additional layers to obtain either the lossless (i.e. bit-exact) original PCM samples or intermediate qualities.

The invention basically follows version c) of the above-listed concepts. However, the inventive embodiments utilise features from concepts a) and b) as well, i.e. a synergistic combination of techniques from several ones of the state-of-the-art lossless audio coding schemes.

The invention uses frequency domain de-correlation, time domain de-correlation, or a combination thereof to prepare the residual signal (error signal) of the base-layer lossy audio codec for efficient lossless encoding. The proposed de-correlation techniques make use of side information that is extracted from the lossy decoder. Thereby, transmission of redundant information in the bit stream is prevented, and the overall compression ratio is improved.

Besides the improved compression ratio, some embodiments of the invention provide the audio signal in one or several intermediate qualities (in the range limited by the lossy codec and mathematically lossless quality). Furthermore, the invention allows for stripping of the embedded lossy bit stream using a simple bit dropping technique.

Three basic embodiments of the invention differ in the domain, in which the de-correlation of the residual signal of the lossy base layer codec takes place: in time domain, in frequency domain, or in both domains in a coordinated manner. In contrast to the prior art, all embodiments utilise information taken from the decoder of the lossy base-layer codec to control the de-correlation and lossless coding process. Some of the embodiments additionally use information from the encoder of the lossy base-layer codec. The exploitation of side information from the lossy base-layer codec allows for reduction of redundancies in the gross bit stream, thus improving the coding efficiency of the lossy based lossless codec.

In all embodiments at least two different variants of the audio signal with different quality levels can be extracted from the bit stream. These variants include the signal represented by the embedded lossy coding scheme and the lossless decoding of the original PCM samples. In some embodiments (see sections Frequency domain de-correlation and De-correlation in frequency and time domain) it is possible to decode one or several further variants of the audio signal with intermediate qualities.

In principle, the inventive encoding method is suited for lossless encoding of a source signal, using a lossy encoded data stream and a lossless extension data stream which together form a lossless encoded data stream for said source signal, said method including the steps:

lossy encoding said source signal, wherein said lossy encoding provides said lossy encoded data stream;

lossy decoding said lossy encoded data, thereby reconstructing a decoded signal and providing side information for controlling a time domain prediction filter;

forming a difference signal between a correspondingly delayed version of said source signal and said decoded signal, prediction filtering said difference signal using filter coefficients that are derived from said side information so as to de-correlate in the time domain the consecutive values of said difference signal;

lossless encoding said de-correlated difference signal to provide said lossless extension data stream;

combining said lossless extension data stream with said lossy encoded data stream to form said lossless encoded data stream, or including the steps:

lossy encoding said source signal, wherein said lossy encoding provides said lossy encoded data stream;

calculating spectral whitening data from quantised coefficients of said lossy encoded data stream and corresponding not yet quantised coefficients received from said lossy encoding, said spectral whitening data representing a finer quantisation of the original coefficients, whereby said calculating is controlled such that the power of the quantised error is essentially constant for all frequencies;

lossy decoding said lossy encoded data using said spectral whitening data, thereby reconstructing a decoded signal;

forming a difference signal between a correspondingly delayed version of said source signal and said decoded signal;

lossless encoding said difference signal to provide said lossless extension data stream;

combining said lossless extension data stream with said lossy encoded data stream and said spectral whitening data to form said lossless encoded data stream, or including the steps:

lossy encoding said source signal, wherein said lossy encoding provides said lossy encoded data stream;

calculating spectral whitening data from quantised coefficients of said lossy encoded data stream and corresponding not yet quantised coefficients received from said lossy encoding, said spectral whitening data representing a finer quantisation of the original coefficients, whereby said calculating is controlled such that the power of the quantised error is essentially constant for all frequencies;

lossy decoding said lossy encoded data using said spectral whitening data, thereby reconstructing a decoded signal, and providing side information for controlling a time domain prediction filter;

forming a difference signal between a correspondingly delayed version of said source signal and said decoded signal;

prediction filtering said difference signal using filter coefficients that are derived from said side information so as to de-correlate in the time domain the consecutive values of said difference signal;

lossless encoding said de-correlated difference signal to provide said lossless extension data stream;

combining said lossless extension data stream with said lossy encoded data stream and said spectral whitening data to form said lossless encoded data stream.

In principle, the inventive decoding method is suited for decoding a lossless encoded source signal data stream, which data stream was derived from a lossy encoded data stream and a lossless extension data stream which together form a lossless encoded data stream for said source signal, wherein:

said source signal was lossy encoded, said lossy encoding providing said lossy encoded data stream;

said lossy encoded data were correspondingly lossy decoded, thereby reconstructing a standard decoded signal and side information was provided for controlling a time domain prediction filter;

a difference signal between a correspondingly delayed version of said source signal and said decoded signal was formed;

said difference signal was prediction filtered using filter coefficients that were derived from said side information so as to de-correlate in the time domain the consecutive values of said difference signal;

said de-correlated difference signal was lossless encoded to provide said lossless extension data stream;

said lossless extension data stream was combined with said lossy encoded data stream to form said lossless encoded data stream, said method including the steps:

de-multiplexing said lossless encoded source signal data stream to provide said lossless extension data stream and said lossy encoded data stream;

lossy decoding said lossy encoded data stream, thereby reconstructing a lossy decoded signal and providing said side information for controlling a time domain prediction filter;

decoding said lossless extension data stream so as to provide said de-correlated difference signal;

inversely de-correlation filtering consecutive values of said de-correlated difference signal using filter coefficients that are derived from said side information;

combining said de-correlation filtered difference signal with said lossy decoded signal to reconstruct said source signal, or wherein:

said source signal was lossy encoded, said lossy encoding providing said lossy encoded data stream;

spectral whitening data were calculated from quantised coefficients of said lossy encoded data stream and corresponding not yet quantised coefficients received from said lossy encoding, said spectral whitening data representing a finer quantisation of the original coefficients, whereby said calculating was controlled such that the power of the quantised error is essentially constant for all frequencies;

said lossy encoded data were lossy decoded using said spectral whitening data, whereby a decoded signal was reconstructed;

a difference signal was formed between a correspondingly delayed version of said source signal and said decoded signal;

said difference signal was lossless encoded to provide said lossless extension data stream;

said lossless extension data stream was combined with said lossy encoded data stream and said spectral whitening data to form said lossless encoded data stream, said method including the steps:

de-multiplexing said lossless encoded source signal data stream to provide said lossless extension data stream and said lossy encoded data stream;

lossy decoding said lossy encoded data stream, using said spectral whitening data, thereby reconstructing a lossy decoded signal;

decoding said lossless extension data stream so as to provide said difference signal;

combining said difference signal with said lossy decoded signal to reconstruct said source signal, or wherein:

said source signal was lossy encoded, said lossy encoding providing said lossy encoded data stream;

spectral whitening data were calculated from quantised coefficients of said lossy encoded data stream and corresponding not yet quantised coefficients were received from said lossy encoding, said spectral whitening data representing a finer quantisation of the original coefficients, whereby said calculating was controlled such that the power of the quantised error is essentially constant for all frequencies;

said lossy encoded data were lossy decoded using said spectral whitening data, thereby reconstructing a decoded signal, and side information for controlling a time domain prediction filter was provided;

a difference signal was formed between a correspondingly delayed version of said source signal and said decoded signal;

said difference signal was prediction filtered using filter coefficients that were derived from said side information so as to de-correlate in the time domain the consecutive values of said difference signal;

said de-correlated difference signal was lossless encoded to provide said lossless extension data stream;

said lossless extension data stream was combined with said lossy encoded data stream and said spectral whitening data to form said lossless encoded data stream, said method including the steps:

de-multiplexing said lossless encoded source signal data stream to provide said lossless extension data stream and said lossy encoded data stream;

lossy decoding said lossy encoded data stream, using said spectral whitening data, thereby reconstructing a lossy decoded signal and providing said side information for controlling a time domain prediction filter;

decoding said lossless extension data stream so as to provide said de-correlated difference signal;

inversely de-correlation filtering consecutive values of said de-correlated difference signal using filter coefficients that are derived from said side information;

combining said de-correlation filtered difference signal with said lossy decoded signal to reconstruct said source signal.

The inventive apparatuses carry out the functions of the corresponding inventive methods.

Advantageous additional embodiments of the invention are disclosed in the respective dependent claims.

DRAWINGS

Figure 1:
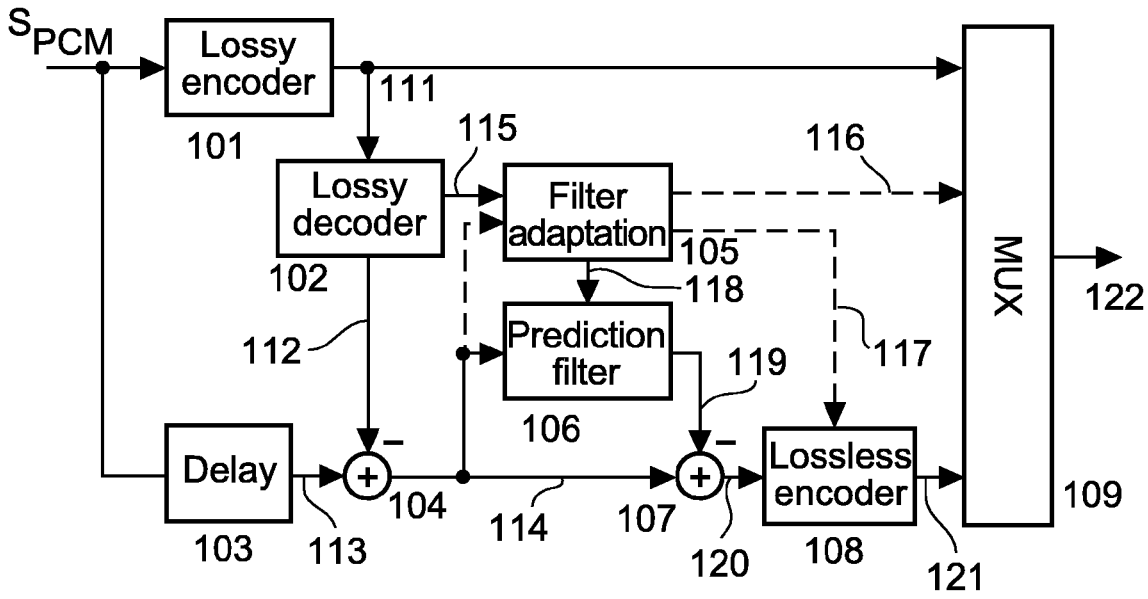
Figure 2:
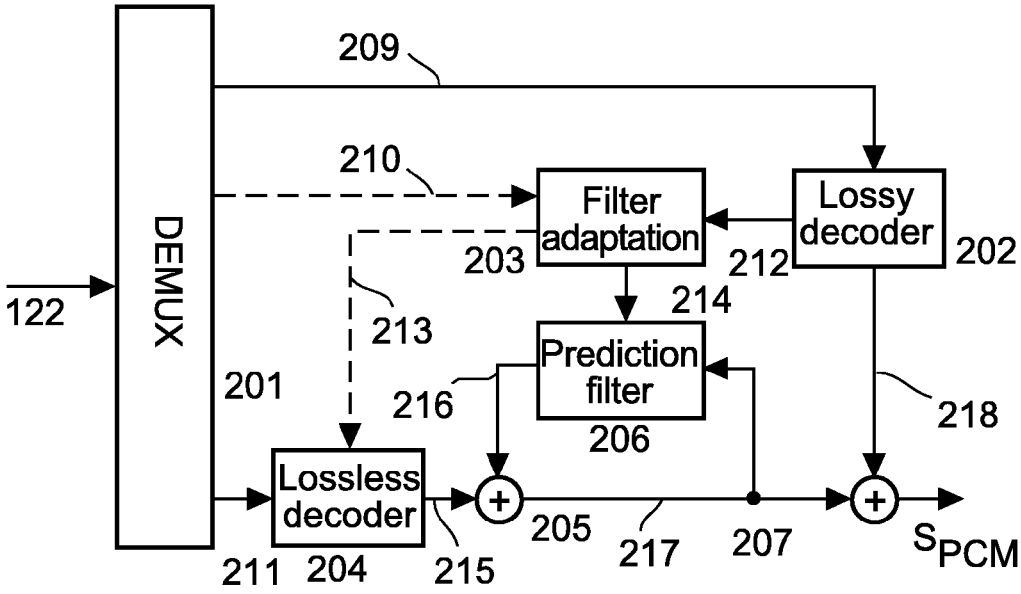
Figure 3:
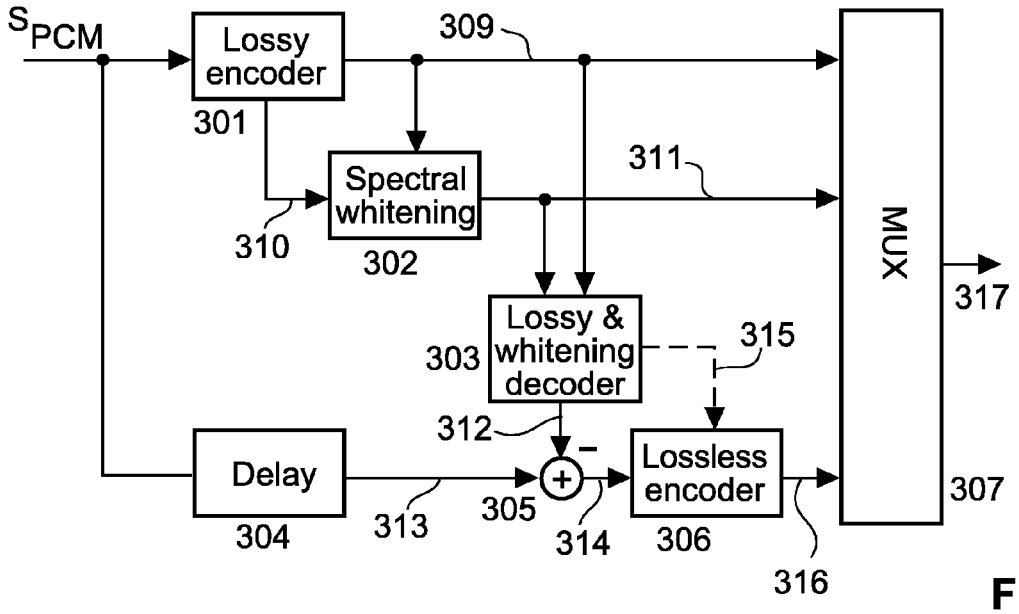
Figure 4:
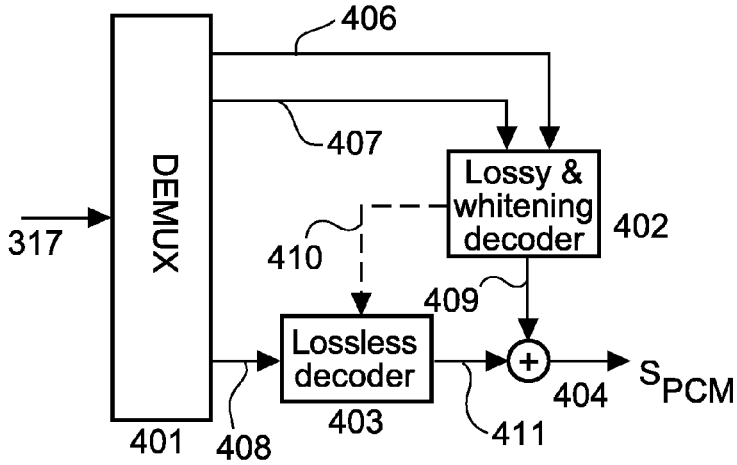
Figure 5:
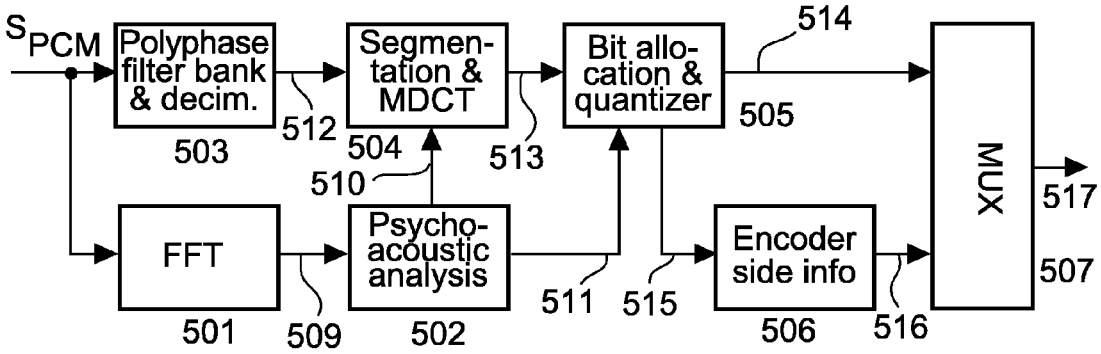
Figure 6:
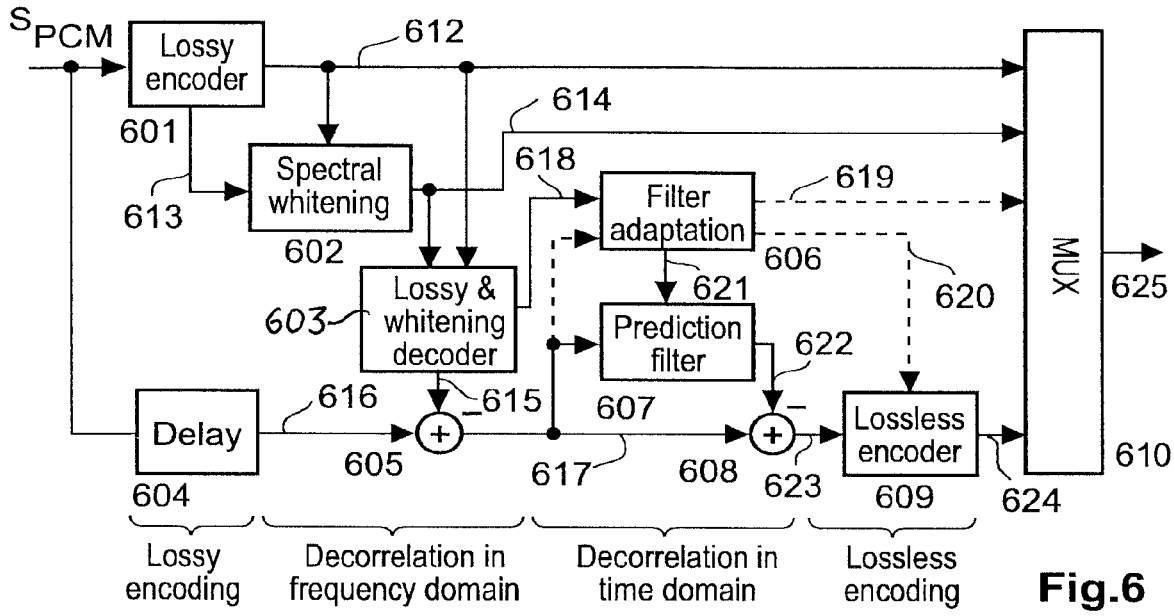
Figure 7:
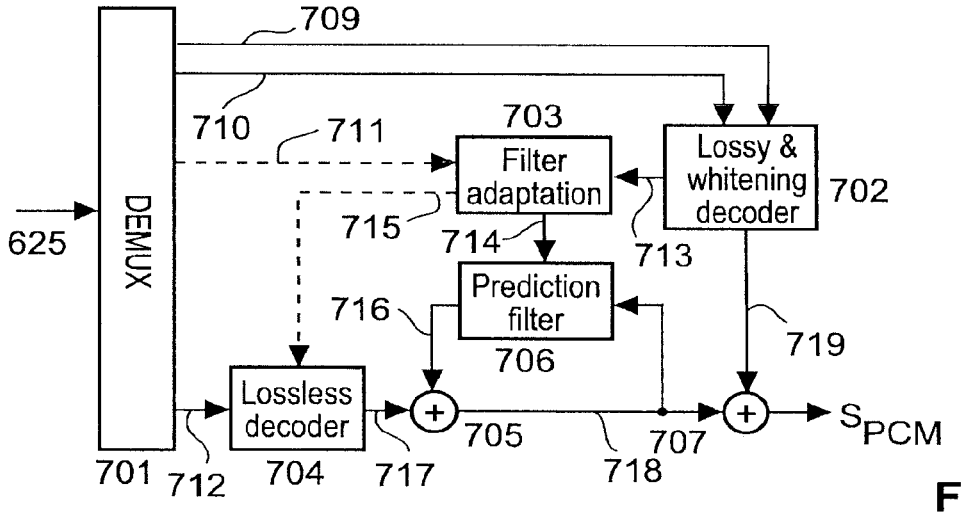

Exemplary embodiments of the invention are described with reference to the accompanying drawings, which show in:

FIG. 1 block diagram or signal flow of lossy based lossless encoder with decor relation of the residual signal using time domain linear prediction;

FIG. 2 block diagram or signal flow of lossy based lossless decoder with decor relation of the residual signal using time domain linear prediction;

FIG. 3 block diagram or signal flow of lossy based lossless encoder with decor relation of the residual signal in frequency domain;

FIG. 4 block diagram or signal flow of lossy based lossless decoder with decor relation of the residual signal in frequency domain;

FIG. 5 block diagram for a known ISO/IEC 11172-3 Layer III encoder;

FIG. 6 block diagram or signal flow of lossy based lossless encoder with decor relation of the residual signal in frequency and time domain;

FIG. 7 block diagram or signal flow of lossy based lossless decoder with de-correlation of the residual signal in frequency and time domain;

FIG. 8 basic block diagram for a known lossy based lossless encoder and decoder;

FIG. 9 general block diagram for a known lossy encoder and decoder.

EXEMPLARY EMBODIMENTS

Time Domain De-correlation

This embodiment makes use of the known residual coding principle.

In the encoding depicted in FIG. 1, the encoding starts with a lossy encoder step or stage 101, yielding the lossy bit stream 111 which is passed to a MUX block 109. A corresponding lossy decoder 102 produces the decoded audio signal 112 and some side information 115 to be used for control of a time domain linear prediction filter. This side information 115 comprises for example a set of parameters that describe the spectral envelope of the error (i.e. the residual signal 114) of the lossy codec 101/102, i.e. of the difference formed in a subtractor 104 between the (lossy) decoded audio signal 112 and the properly delayed original PCM samples 113. Delay 103 compensates for any algorithmic delay that is caused by the chain of lossy encoder 101 and lossy decoder 102. The side information can also include one or more of the following: block sizes, window functions, cut-off frequencies, bit allocations.

The side information 115 that is extracted from the lossy decoder 102 (and possibly signal 114, in particular in case the lossy encoder 101 encodes a partial audio signal frequency range only, or for facilitating a more exact determination of the filter coefficients in step/stage 105) is used in a filter adaptation block 105 to determine a set 118 of optimum filter coefficients to be applied in a linear prediction filter 106. The aim of the prediction filtering and the subtraction 107 is to produce a de-correlated output signal 120 with a flat (i.e. 'white') spectrum. A white signal is perfectly de-correlated, and the corresponding consecutive time domain samples or values exhibit the lowest possible power and entropy. Thus, a better de-correlation of the signal leads to lossless coding with lower average data rate. Compared to known lossy based lossless approaches, the invention allows for a very good de-correlation, but without the need to transmit a large amount of information on the prediction filter settings. The corresponding information stream 116 is always lower in data rate than for systems without exploitation of side information 115 from the lossy decoder. Ultimately, the extra information 116 to be transmitted for the adaptation of the prediction filter coefficients at decoding side may be zero. That is, the coding efficiency of the proposed approach is always better than that of similar lossy based lossless audio coding methods.

In general, any useful information (parameters, signals etc.) from the lossy decoder can be exploited to improve both the adaptation of the prediction filter and the lossless encoder.

To be operational, the lossy decoder 102, the time domain linear prediction filter 106, the delay compensation 103, the subtraction points 104 and 107, and any interpolation functionalities, that may optionally be implemented inside the lossy decoder block 102, are to be implemented in a platform-independent manner. That is, for all targeted platforms a fixed-point implementation with integer precision is required that produces bit-exactly reproducible results.

The prediction error signal 120 is fed to a lossless encoding block 108 which produces an encoded bit stream 121. Advantageously, since the prediction error signal 120 can be assumed to be de-correlated (white), a simple memoryless entropy coding (e.g. Rice coding) may be used in lossless encoder 108. The lossless encoding may be supported optionally by additional side information 117 to be derived during filter adaptation of filter adaptation block 105. For example, the estimated power of the residual signal 120 may be provided as side information 117, which is a by-product of state-of-the-art prediction filter adaptation methods. Multiplexer 109 combines the partial bit streams 111, 116 and 121 to form output bit stream signal 122, and may produce different file formats or bit stream formats for output bit stream 122.

The term 'lossy decoder' means the exact decoding of the lossy encoded bit stream, i.e. the inverse operation of the lossy encoder.

In the decoding in FIG. 2, the incoming gross bit stream 122 is split into sub bit streams by a demultiplexer 201. A lossy decoder 202, implemented to produce exactly the same outputs as decoder 102 in a platform-independent manner, produces the lossy decoded time signal 218 and side information 212. From this side information and any optional bit stream components 210 (corresponding to signal 116 in FIG. 1), the filter adaptation can be performed in filter adaptation block 203 exactly like in the corresponding encoding block 105. Demultiplexer 201 also provides a lossy extension bit stream 211 to a lossless decoder 204, the output signal 215 of which is fed to an inverse de-correlation filter comprising an adder 205 and a prediction filter 206 that is controlled by the filter coefficients 214 provided by block 212, thus producing a bit-exact replica 217 of the lossy codec error signal 114. Addition 207 of this error signal to the decoded signal 218 from lossy decoder 202 yields the original PCM samples $S_{PCM}$. Fiter coefficients 214 are identical to filter coefficients 118. The operations of elements 202, 204, 205, 206 and 207 are identical to that of the respective elements 102, 108, 107, 106 and 104.

Optional Embodiments

This basic processing can be applied in different manners. Instead of the feed-forward linear prediction filter structure comprising blocks 106 and 107 in FIG. 1, other variants of time domain linear prediction filters may be used. For example, backward prediction or a combination of backward prediction and the above-described forward prediction. Another option is to use a long-term prediction filter in addition to any of these short-term prediction techniques.

Additional side information 117/213, extracted from the filter adaptation block 105/203, can be used to control the lossless encoding/decoding block 108/204. For example, the standard deviation of the prediction residual, as estimated by common filter adaptation techniques, can be used to parameterise the lossless coding, e.g. for selecting Huffman tables. This option is illustrated by the dashed lines for signals 117/213 in FIGS. 1 and 2.

The proposed embodiments can be applied on top of all kinds of codecs for which it is possible to determine or estimate the power spectrum of the error signal from the set of parameters available at the decoder. Thus, this hierarchical codec processing can be applied to a wide range of audio and speech codecs.

An Example Implementation

Assuming that the lossy base-layer codec is compliant to the mp3 standard, it is possible to determine optimum coefficients for a time domain linear prediction filter from the set of scale factors. In the mp3 codec, the scale factors describe the quantisation step size to be applied for encoding the MDCT coefficients. That is, it is possible to derive the envelope of the power spectrum of the error signal from the set of scale factors for each signal frame (granule).

Let $S_{ee}(i)$ denote the scale factor for the i-th MDCT coefficient, represented in the power spectrum domain. Then, the auto-correlation coefficients $\phi_{ee}(k)=\mathrm{IDFT}\{S_{ee}(i)\}$ can be determined by inverse discrete Fourier transform (IDFT). Application of the Levinson-Durbin algorithm (Makhoul, cited above) will produce the desired set $\alpha_i$, i=1 . . . p of optimum filter co-efficients 118/214 to be applied in the p-th order linear prediction filter 106/206. This procedure is repeated for each frame (granule) of the audio signal. In addition to the set of filter coefficients $\alpha_i$, i=1 . . . p, the Levinson-Durbin algorithm produces the expected variance of the prediction error signal 120/215. This variance is important information to control the subsequent lossless encoding 108 of the prediction residuum.

If the mp3 encoder excludes certain frequency ranges from bit allocation (e.g. high frequencies at low data rates), or uses advanced coding tools, more sophisticated schemes are applied. Further, in certain frequency ranges the estimate $S_{ee}(i)$ of the power spectrum of the error signal may not have the desired precision to be used for filter adaptation. Then, additional information is to be obtained by examination of the error signal 114. This may be performed both in time domain and in frequency domain.

Frequency Domain De-correlation

In this embodiment the de-correlation of the residual is performed in the transform domain of the lossy codec. However, the actual lossless coding is still performed in the time domain. Therefore, this method is different from known lossy based lossless schemes and transform based lossless coding approaches. The proposed embodiment combines the advantages of transform domain de-correlation and time domain based lossless coding approaches.

In the encoding depicted in FIG. 3, a lossy encoder 301 uses some transform of the original signal $S_{PCM}$ (or a sub-band signal thereof) before quantising the transform coefficients using adaptive or fixed bit allocation. Without loss of generality, it is assumed in the following that the lossy encoder is based on a frequency transform. After the lossy encoder 301 has produced an embedded backwards-compatible lossy signal part 309 of the combined bit stream 317, a 'spectral whitening' block 302 is applied the purpose of which is to determine the error signal of lossy coder 301 in the transform domain, and to perform additional quantisation of these error coefficients in order to achieve a spectrally flat (i.e. 'white') error floor for the magnitudes of consecutive values of an extension data signal to be encoded. Lossy audio codecs in general apply sophisticated noise shaping techniques to obtain an error spectrum that adheres to the non-white masking threshold of the human ear. The spectral whitening block requires at least the original transform coefficients 310 and the quantised transform coefficients 309 contained in the bit stream as input signals. Such whithening can be achieved by quantising the error within the frequency domain. The difference signal between the original transform coefficients 310 and the quantised transform coefficients 309 in the frequency domain is a mirror or image of the difference signal 314 in the time domain.

The output bit stream 309 of the lossy encoder and the additional information 311 from the spectral whitening block 302 are fed into an extended lossy and whitening decoder block 303 and to a multiplexer 307. The resulting time domain signal 312 is subtracted 305 from the properly delayed version 313 (compensating any delay of the lossy codec) of the original signal $S_{PCM}$, producing a residual signal 314. Owing to the spectral whitening process, this residual signal has a flat spectrum, i.e. there is negligible correlation between successive samples. The residual signal can be directly fed into a lossless encoder 306 which outputs a lossless extension stream 316. Optionally, side information (see the examples given above; in particular advantageous is the average power of the error signal) 315 from the lossy & whitening decoder 303 can be utilised to control the lossless encoder 306.

To be operational, the lossy & whitening decoder 303, subtractor 305 and any interpolation functionalities that may optionally be implemented inside the lossy decoder block, are implemented in a platform-independent manner. That is, for all targeted platforms a fixed-point implementation with integer precision is required that produces bit-exactly re-producible results.

Multiplexer 307 combines the partial bit streams 309, 311 and 316 to form output bit stream signal 317, and may produce different file formats or bit stream formats.

In the decoding shown in FIG. 4, the received bit stream 317 is de-multiplexed 401 and split into the individual signal layers 406, 407 and 408. Both the embedded lossy bit stream 406 and the spectral whitening bit stream 407 are fed into a lossy and whitening decoder 402. The resulting time domain signal 409 is a bit-exact replica of the intermediate-quality signal 312 in the encoding. A lossless decoder 403 gets inputs from bit stream 408 and optionally from the lossy and whitening decoder (side information 410) to produce the residual signal 411. The final output signal $S_{PCM}$ is obtained by adding the intermediate-quality signal 409 to the lossless decoded residual signal 411.

The operations of elements 402, 403 and 404 are identical to that of the respective elements 303, 306 and 305.

Optional Embodiments

There are several possibilities to control the power of the residual signal by allocating a larger or smaller amount of bits for the spectral whitening. One option is to target a constant power of the residual signal, by a varying amount of quantisation in the spectral whitening block 302, and allowing for a fixed setup of the time domain lossless coding 306. Another option is to allow a variable power level of the time domain residual signal.

By exploiting the parts of the bit stream that are produced by the lossy encoder 301 and by the spectral whitening block 302, a tailored decoder may produce an output signal with an intermediate quality that is between the quality of the embedded lossy codec and the mathematically lossless decoding of the original PCM samples. This intermediate quality depends on the power of the residual signal, controlled in one of the manners described in the previous paragraph. Such decoder may not include the lossless decoder 403 and adder 404 and would not process bitstream 316/408.

To support the generation of more than one intermediate-quality signal, a layered organisation of the spectral whitening information 311 is possible. By this, a codec can be specified which has an arbitrary number of intermediate quality levels in the range defined by the lossy codec (lowest quality) and the original PCM samples (highest quality). The different quality levels can be organised such as to provide a scalable bit stream.

An Example Implementation

An example embodiment of the invention is based on the mp3 standard. A block diagram of an mp3 compliant encoder is shown in FIG. 5. In the context of FIG. 3, the mp3 encoder of FIG. 5 (possibly except MUX 507, depending on the bit stream or file format) is part of the lossy encoder block 301.

The original input signal $S_{PCM}$ passes through a polyphase filter bank & decimator 503, a segmentation & MDCT 504 and a bit allocation and quantiser 505 to multiplexer 507. Input signal $S_{PCM}$ also passes through an FFT stage or step 501 to a psycho-acoustic analysis 502 which controls the segmentation (or windowing) in step/stage 504 and the quantisation 505. The bit allocation and quantiser 505 also provides side information 515 that passes through a side info encoder 506 to multiplexer 507 which outputs signal 517.

Let x denote an individual but arbitrary original transform coefficient from the output vector 513 of block 504, i.e. in the MDCT domain for mp3, and let $\hat{x}$ denote the quantised version of the same coefficient, represented and encoded by the bit stream 514, which is part of output signal 517 or 309, respectively. In addition to the bit stream 309/517, the original vector of MDCT coefficients 513 is passed on to the spectral whitening block 302. Accordingly, signal 310 comprises signal 513 and optionally additional useful side information from the mp3 encoder. In the spectral whitening block 302, the error $e=x-\hat{x}$ of the mp3 codec is quantised by a second quantiser with the aim to obtain a white error floor, i.e. a spectrally flat (white) error spectrum $e-\hat{e}$, $\hat{e}-=Q(e)$. Thus, the bit allocation to be applied in the spectral whitening block shall be controlled such that the condition $E\{(e-\hat{e})^2\}$=constant is met, wherein E is the expectation value.

For the spectral whitening quantiser known quantisation techniques can be used, e.g. scalar or lattice quantisation followed by entropy coding, or optimised (trained) fixed-entropy scalar or vector quantisation. The best results are expected if the spectral whitening quantiser is selected and optimised in dependence on the parameter values of the original mp3 quantiser of the spectral coefficient. That is, the spectral whitening quantiser should be a conditional quantiser.

De-correlation in Frequency and Time Domains

This embodiment combines features described in the sections time domain de-correlation and frequency domain de-correlation. The de-correlation is split into two sub-systems, operating in frequency domain and in time domain, respectively.

In the encoding depicted in FIG. 6, a lossy encoder 601 uses some transform of the original signal $S_{PCM}$ (or a sub-band signal thereof) before quantising the transform coefficients with adaptive or fixed bit allocation. Without loss of generality, it is assumed in the following that encoder 601 uses a frequency transform. After having produced an embedded backwards-compatible lossy signal part 612 of the combined bit stream 625, a spectral whitening block 602 is applied the purpose of which is to determine the error signal of encoder 601 in the transform domain, and to perform additional quantisation of these error coefficients in order to achieve for consecutive values of the extension data signal to be encoded an error floor that is spectrally more flat or white than that of the input error spectrum of the lossy decoder. The spectral whitening block requires at least the original transform coefficients 613 and the quantised transform coefficients 612 as input signals.

The output bit stream 612 of the lossy encoder and the corresponding additional information 614 from the spectral whitening block 602 are fed to a lossy and whitening decoder block 603 and to a multiplexer 610. Its resulting time domain output signal 615 is subtracted 605 from the properly delayed version 616 of the original signal $S_{PCM}$, producing a residual signal 617.

The still remaining weak correlation between successive samples of the residual signal 617 is removed in a linear prediction filter 607. The side information (see the examples given above, e.g. the envelope of the error spectrum) 618 that is extracted from the lossy and whitening decoder block 603 is used in a filter adaptation block 606 to determine a set 621 of optimum filter coefficients to be applied in filter 607. The aim of the prediction filtering and the subtraction 608 is to produce a completely de-correlated output signal 623 with a flat or white spectrum. This residual signal passes through a lossless encoder 609 which outputs a lossless extension stream 624. Optionally, side information (see the examples given above, e.g. the signal power) 620 from filter adaptation block 606 can be utilised to control encoder 609. Information from block 606 about the prediction filter settings is optionally sent to multiplexer 610. The corresponding information stream 619 is always lower in data rate than for systems without exploitation of side information 618.

Multiplexer 610 combines the partial bit streams 612, 614, 619 and 624 to form output signal 625, and may produce different file formats or bit stream formats.

In the decoding depicted in FIG. 7, the received bit stream 625 is split by a demultiplexer 701 into the individual signal layers 709, 710, 711 and 712. Both, the embedded lossy bit stream 709 and the spectral whitening bit stream 710, are fed to a lossy and whitening decoder 702. Its lossy or intermediate-quality time domain output signal 719 is a bit-exact replica of the lossy or intermediate-quality signal 615 in the encoding.

Decoder 702 also provides side information 713 to a filter adaptation block 703. From this side information and any optional bit stream components 711 (corresponding to signal 619 in FIG. 6), a filter adaptation is performed exactly like in the corresponding encoding block 606.

A lossless decoder 704 gets inputs from lossless extension bit stream 712 and optionally from side information 715 (corresponding to side information 620 in FIG. 6) output by filter adaptation block 703, to produce the (partially) de-correlated residual signal 717 (corresponds to signal 623 in FIG. 6). That signal is fed to an inverse de-correlation filter comprising an adder 705 and a prediction filter 706 that is controlled by the filter coefficients 714 provided by block 703, thus producing a bit-exact replica 718 of the residual signal 617. The final output signal $S_{PCM}$ is obtained by combining in adder 707 the lossy decoded signal 719 and the lossless decoded residual signal 718. Fiter co-efficients 714 are identical to filter coefficients 621. The operations of elements 702, 704, 705, 706 and 707 are identical to that of the respective elements 603, 609, 608, 607 and 605.

Although the functions or operations of these blocks basically adhere to the operations described in FIGS. 1 and 3, or 2 and 4, respectively, there is a difference concerning the control of the manner and amount of de-correlation to be applied in frequency domain and in time domain.

One strategy to control the balance between frequency and time domain de-correlation is to constrain the summed data rate of the lossy part and spectral whitening part of the bit stream. If there is a fixed upper limit to the data rate of these two components of the bit stream, the spectral whitening can only perform a certain portion of the task of de-correlation of the error signal. That is, the time domain residual signal 617 will still exhibit a certain amount of correlation. This remaining correlation is removed by the downstream time domain de-correlation using linear prediction filtering, exploiting information taken from the lossy & whitening decoder, as described in section time domain de-correlation.

Another strategy is to use frequency domain de-correlation only to remove long-term correlation from the residual signal, i.e. correlation characteristics of the signal which are narrow (or 'peaky') in frequency domain, corresponding to tonal components of the residual signal. Subsequently, the time domain de-correlation by linear prediction filtering is optimised and used to remove the remaining short-term correlation from the residual signal. Advantageously, thereby both de-correlation techniques are used in their specifically best operation points. Hence, this kind of processing allows very efficient encoding with low computational complexity.

Optional Embodiments

There are several possibilities to control the power of the residual signal by allocating a larger or smaller amount of bits for the spectral whitening. One option is to target a constant power of the residual signal, by a varying amount of quantisation in the spectral whitening block 602, and allowing for a fixed setup of the time domain lossless coding 609. Another option is to allow a variable power level of the time domain residual signal.

By exploiting the parts of the bit stream that are produced by the lossy encoder 601 and by the spectral whitening block 602, a tailored decoder may produce an output signal with an intermediate quality that is between the quality of the embedded lossy codec and the mathematically lossless decoding of the original PCM samples. This intermediate quality depends on the power of the residual signal, controlled in one of the manners described in the previous paragraph. Such decoder may not include the lossless decoder 704, filter adaptation block 703, prediction filter 706 and adders 705 and 707.

The invention claimed is:

1. Method for lossless encoding of a source signal, using a lossy encoded data stream and a lossless extension data stream which together form a lossless encoded data stream for said source signal, said method comprising the steps:

lossy encoding said source signal, wherein said lossy encoding provides said lossy encoded data stream, comprising:

lossy decoding said lossy encoded data, thereby reconstructing a decoded signal and providing side information for controlling a time domain prediction filter;

forming a difference signal between a correspondingly delayed version of said source signal and said decoded signal, prediction filtering said difference signal using filter coefficients that are derived from said side information so as to de-correlate in the time domain the consecutive values of said difference signal;

lossless encoding said de-correlated difference signal to provide said lossless extension data stream;

combining said lossless extension data stream with said lossy encoded data stream to form said lossless encoded data stream.

2. Method according to claim 1, wherein from said side information prediction filter settings data are derived and included in said lossless encoded data stream, or side information prediction filter settings data are taken from said lossless encoded data stream and are used for generating said prediction filtering coefficients.

3. Method according to claim 1, wherein the standard deviation of the prediction residual is used to parameterize said lossless encoding, or to control said lossless decoding, respectively.

4. Method for lossless encoding of a source signal, using a lossy encoded data stream and a lossless extension data stream which together form a lossless encoded data stream for said source signal, said method comprising the steps:

lossy encoding said source signal, wherein said lossy encoding provides said lossy encoded data stream, comprising:

calculating spectral whitening data from quantized coefficients of said lossy encoded data stream and corresponding not yet quantized coefficients received from said lossy encoding, said spectral whitening data representing a finer quantization of the original coefficients, whereby said calculating is controlled such that the power of the quantized error is essentially constant for all frequencies;

lossy decoding said lossy encoded data using said spectral whitening data, thereby reconstructing a decoded signal;

forming a difference signal between a correspondingly delayed version of said source signal and said decoded signal;

lossless encoding said difference signal to provide said lossless extension data stream;

combining said lossless extension data stream with said lossy encoded data stream and said spectral whitening data to form said lossless encoded data stream.

5. Method according to claim 4, wherein side information from said lossy decoder is used to control said lossless encoding, or said lossless decoding, respectively.

6. Method for lossless encoding of a source signal, using a lossy encoded data stream and a lossless extension data stream which together form a lossless encoded data stream for said source signal, said method comprising the steps:

lossy encoding said source signal, wherein said lossy encoding provides said lossy encoded data stream, comprising:

calculating spectral whitening data from quantized coefficients of said lossy encoded data stream and corresponding not yet quantized coefficients received from said lossy encoding, said spectral whitening data representing a finer quantization of the original coefficients, whereby said calculating is controlled such that the power of the quantized error is essentially constant for all frequencies;

lossy decoding said lossy encoded data using said spectral whitening data, thereby reconstructing a decoded signal, and providing side information for controlling a time domain prediction filter;

forming a difference signal between a correspondingly delayed version of said source signal and said decoded signal;

prediction filtering said difference signal using filter coefficients that are derived from said side information so as to de-correlate in the time domain the consecutive values of said difference signal;

lossless encoding said de-correlated difference signal to provide said lossless extension data stream;

combining said lossless extension data stream with said lossy encoded data stream and said spectral whitening data to form said lossless encoded data stream.

7. Method according to claim 6, wherein from said side information prediction filter settings data are derived and included in said lossless encoded data stream, or side information prediction filter settings data are taken from said lossless encoded data stream and are used for generating said prediction filtering coefficients.

8. Method according to claim 6, wherein the standard deviation of the prediction residual is used to parameterize said lossless encoding, or to control said lossless decoding, respectively.

9. Apparatus for lossless encoding of a source signal, using a lossy encoded data stream and a lossless extension data stream which together form a lossless encoded data stream for said source signal, said apparatus comprising:

means being adapted for lossy encoding said source signal, wherein said lossy encoding provides said lossy encoded data stream, comprising:

means being adapted for lossy decoding said lossy encoded data, thereby reconstructing a decoded signal and providing side information for controlling a time domain prediction filter;

means being adapted for forming a difference signal between a correspondingly delayed version of said source signal and said decoded signal, means being adapted for prediction filtering said difference signal using filter coefficients that are derived from said side information so as to de-correlate in the time domain the consecutive values of said difference signal;

means being adapted for lossless encoding said de-correlated difference signal to provide said lossless extension data stream;

means being adapted for combining said lossless extension data stream with said lossy encoded data stream to form said lossless encoded data stream.

10. Apparatus according to claim 9, wherein from said side information prediction filter settings data are derived and included in said lossless encoded data stream, or side information prediction filter settings data are taken from said lossless encoded data stream and are used for generating said prediction filtering coefficients.

11. Apparatus according to claim 9, wherein the standard deviation of the prediction residual is used to parameterize said lossless encoding, or to control said lossless decoding, respectively.

12. Apparatus for lossless encoding of a source signal, using a lossy encoded data stream and a lossless extension data stream which together form a lossless encoded data stream or said source signal, said apparatus comprising:

means being adapted for lossy encoding said source signal, wherein said lossy encoding provides said lossy encoded data stream, comprising:

means being adapted for calculating spectral whitening data from quantized coefficients of said lossy encoded data stream and corresponding not yet quantized coefficients received from said lossy encoding, said spectral whitening data representing a finer quantization of the original coefficients, whereby said calculating is controlled such that the power of the quantized error is essentially constant for all frequencies;

means being adapted for lossy decoding said lossy encoded data using said spectral whitening data, thereby reconstructing a decoded signal;

means being adapted for forming a difference signal between a correspondingly delayed version of said source signal and said decoded signal;

means being adapted for lossless encoding said difference signal to provide said lossless extension data stream;

means being adapted for combining said lossless extension data stream with said lossy encoded data stream and said spectral whitening data to form said lossless encoded data stream.

13. Apparatus according to claim 12, wherein side information from said lossy decoder is used to control said lossless encoding, or said lossless decoding, respectively.

14. Apparatus for lossless encoding of a source signal, using a lossy encoded data stream and a lossless extension data stream which together form a lossless encoded data stream for said source signal, said apparatus comprising:

means being adapted for lossy encoding said source signal, wherein said lossy encoding provides said lossy encoded data stream, comprising:

means being adapted for calculating spectral whitening data from quantized coefficients of said lossy encoded data stream and corresponding not yet quantized coefficients received from said lossy encoding, said spectral whitening data representing a finer quantization of the original coefficients, whereby said calculating is controlled such that the power of the quantized error is essentially constant for all frequencies;

means being adapted for lossy decoding said lossy encoded data using said spectral whitening data, thereby reconstructing a decoded signal, and providing side information for controlling a time domain prediction filter;

means being adapted for forming a difference signal between a correspondingly delayed version of said source signal and said decoded signal;

means being adapted for prediction filtering said difference signal using filter coefficients that are derived from said side information so as to de-correlate in the time domain the consecutive values of said difference signal;

means being adapted for lossless encoding said de-correlated difference signal to provide said lossless extension data stream;

means being adapted for combining said lossless extension data stream with said lossy encoded data stream and said spectral whitening data to form said lossless encoded data stream.

15. Apparatus according to claim 14, wherein from said side information prediction filter settings data are derived and included in said lossless encoded data stream, or side information prediction filter settings data are taken from said lossless encoded data stream and are used for generating said prediction filtering coefficients.

16. Apparatus according to claim 14, wherein the standard deviation of the prediction residual is used to parameterize said lossless encoding, or to control said lossless decoding, respectively.

17. Method for decoding a lossless encoded source signal data stream, which data stream was derived from a lossy encoded data stream and a lossless extension data stream which together form a lossless encoded data stream for said source signal, wherein:

said source signal was lossy encoded, said lossy encoding providing said lossy encoded data stream;

said lossy encoded data were correspondingly lossy decoded, thereby reconstructing a standard decoded signal and side information was provided for controlling a time domain prediction filter;

a difference signal between a correspondingly delayed version of said source signal and said decoded signal was formed;

said difference signal was prediction filtered using filter coefficients that were derived from said side information so as to de-correlate in the time domain the consecutive values of said difference signal;

said de-correlated difference signal was lossless encoded to provide said lossless extension data stream;

said lossless extension data stream was combined with said lossy encoded data stream to form said lossless encoded data stream, said method comprising the steps:

de-multiplexing said lossless encoded source signal data stream to provide said lossless extension data stream and said lossy encoded data stream;

lossy decoding said lossy encoded data stream, thereby reconstructing a lossy decoded signal and providing said side information for controlling a time domain prediction filter;

decoding said lossless extension data stream so as to provide said de-correlated difference signal;

inversely de-correlation filtering consecutive values of said de-correlated difference signal using filter coefficients that are derived from said side information;

combining said de-correlation filtered difference signal with said lossy decoded signal to reconstruct said source signal.

18. Method according to claim 17, wherein from said side information prediction filter settings data are derived and included in said lossless encoded data stream, or side information prediction filter settings data are taken from said lossless encoded data stream and are used for generating said prediction filtering coefficients.

19. Method according to claim 17, wherein the standard deviation of the prediction residual is used to parameterize said lossless encoding, or to control said lossless decoding, respectively.

20. Method for decoding a lossless encoded source signal data stream, which data stream was derived from a lossy encoded data stream and a lossless extension data stream which together form a lossless encoded data stream for said source signal, wherein:

said source signal was lossy encoded, said lossy encoding providing said lossy encoded data stream;

spectral whitening data were calculated from quantized coefficients of said lossy encoded data stream and corresponding not yet quantized coefficients received from said lossy encoding, said spectral whitening data representing a finer quantization of the original coefficients, whereby said calculating was controlled such that the power of the quantized error is essentially constant for all frequencies;

said lossy encoded data were lossy decoded using said spectral whitening data, whereby a decoded signal was reconstructed;

a difference signal was formed between a correspondingly delayed version of said source signal and said decoded signal;

said difference signal was lossless encoded to provide said lossless extension data stream;

said lossless extension data stream was combined with said lossy encoded data stream and said spectral whitening data to form said lossless encoded data stream, said method comprising the steps:

de-multiplexing said lossless encoded source signal data stream to provide said lossless extension data stream and said lossy encoded data stream;

lossy decoding said lossy encoded data stream, using said spectral whitening data, thereby reconstructing a lossy decoded signal;

decoding said lossless extension data stream so as to provide said difference signal;

combining said difference signal with said lossy decoded signal to reconstruct said source signal.

21. Method according to claim 20, wherein side information from said lossy decoder is used to control said lossless encoding, or said lossless decoding, respectively.

22. Method according to claim 20, wherein said lossless extension data stream is not evaluated and said spectral whitening data are used together with said lossy encoded data stream to decode an output signal having an intermediate quality lower than that of said source signal.

23. Method for decoding a lossless encoded source signal data stream, which data stream was derived from a lossy encoded data stream and a lossless extension data stream which together form a lossless encoded data stream for said source signal, wherein:

said source signal was lossy encoded, said lossy encoding providing said lossy encoded data stream;

spectral whitening data were calculated from quantized coefficients of said lossy encoded data stream and corresponding not yet quantized coefficients were received from said lossy encoding, said spectral whitening data representing a finer quantization of the original coefficients, whereby said calculating was controlled such that the power of the quantized error is essentially constant for all frequencies;

said lossy encoded data were lossy decoded using said spectral whitening data, thereby reconstructing a decoded signal, and side information for controlling a time domain prediction filter was provided;

a difference signal was formed between a correspondingly delayed version of said source signal and said decoded signal;

said difference signal was prediction filtered using filter coefficients that were derived from said side information so as to de-correlate in the time domain the consecutive values of said difference signal;

said de-correlated difference signal was lossless encoded to provide said lossless extension data stream;

said lossless extension data stream was combined with said lossy encoded data stream and said spectral whitening data to form said lossless encoded data stream, said method comprising the steps:

de-multiplexing said lossless encoded source signal data stream to provide said lossless extension data stream and said lossy encoded data stream;

lossy decoding said lossy encoded data stream, using said spectral whitening data, thereby reconstructing a lossy decoded signal and providing said side information for controlling a time domain prediction filter;

decoding said lossless extension data stream so as to provide said de-correlated difference signal;

inversely de-correlation filtering consecutive values of said de-correlated difference signal using filter coefficients that are derived from said side information;

combining said de-correlation filtered difference signal with said lossy decoded signal to reconstruct said source signal.

24. Method according to claim 23, wherein from said side information prediction filter settings data are derived and included in said lossless encoded data stream, or side information prediction filter settings data are taken from said lossless encoded data stream and are used for generating said prediction filtering coefficients.

25. Method according to claim 23, wherein the standard deviation of the prediction residual is used to parameterize said lossless encoding, or to control said lossless decoding, respectively.

26. Method according to claim 23, wherein said lossless extension data stream is not evaluated and said spectral whitening data are used together with said lossy encoded data stream to decode an output signal having an intermediate quality lower than that of said source signal.

27. Apparatus for decoding a lossless encoded source signal data stream, which data stream was derived from a lossy encoded data stream and a lossless extension data stream which together form a lossless encoded data stream for said source signal, wherein:

said source signal was lossy encoded, said lossy encoding providing said lossy encoded data stream;

said lossy encoded data were correspondingly lossy decoded, thereby reconstructing a standard decoded signal and side information was provided for controlling a time domain prediction filter;

a difference signal between a correspondingly delayed version of said source signal and said decoded signal was formed;

said difference signal was prediction filtered using filter coefficients that were derived from said side information so as to de-correlate in the time domain the consecutive values of said difference signal;

said de-correlated difference signal was lossless encoded to provide said lossless extension data stream;

said lossless extension data stream was combined with said lossy encoded data stream to form said lossless encoded data stream, said apparatus comprising:

means being adapted for de-multiplexing said lossless encoded source signal data stream to provide said lossless extension data stream and said lossy encoded data stream;

means being adapted for lossy decoding said lossy encoded data stream, thereby reconstructing a lossy decoded signal and providing said side information for controlling a time domain prediction filter;

means being adapted for decoding said lossless extension data stream so as to provide said de-correlated difference signal;

means being adapted for inversely de-correlation filtering consecutive values of said de-correlated difference signal using filter coefficients that are derived from said side information;

means being adapted for combining said de-correlation filtered difference signal with said lossy decoded signal to reconstruct said source signal.

28. Apparatus according to claim 27, wherein from said side information prediction filter settings data are derived and included in said lossless encoded data stream, or side information prediction filter settings data are taken from said lossless encoded data stream and are used for generating said prediction filtering coefficients.

29. Apparatus according to claim 27, wherein the standard deviation of the prediction residual is used to parameterize said lossless encoding, or to control said lossless decoding, respectively.

30. Apparatus for decoding a lossless encoded source signal data stream, which data stream was derived from a lossy encoded data stream and a lossless extension data stream which together form a lossless encoded data stream for said source signal, wherein:

said source signal was lossy encoded, said lossy encoding providing said lossy encoded data stream;

spectral whitening data were calculated from quantized coefficients of said lossy encoded data stream and corresponding not yet quantized coefficients received from said lossy encoding, said spectral whitening data representing a finer quantization of the original coefficients, whereby said calculating was controlled such that the power of the quantized error is essentially constant for all frequencies;

said lossy encoded data were lossy decoded using said spectral whitening data, whereby a decoded signal was reconstructed;

a difference signal was formed between a correspondingly delayed version of said source signal and said decoded signal;

said difference signal was lossless encoded to provide said lossless extension data stream; said lossless extension data stream was combined with said lossy encoded data stream and said spectral whitening data to form said lossless encoded data stream, said apparatus comprising:

means being adapted for de-multiplexing said lossless encoded source signal data stream to provide said lossless extension data stream and said lossy encoded data stream;

means being adapted for lossy decoding said lossy encoded data stream, using said spectral whitening data, thereby reconstructing a lossy decoded signal;

means being adapted for decoding said lossless extension data stream so as to provide said difference signal;

means being adapted for combining said difference signal with said lossy decoded signal to reconstruct said source signal.

31. Apparatus according to claim 30, wherein side information from said lossy decoder is used to control said lossless encoding, or said lossless decoding, respectively.

32. Apparatus according to claim 30, wherein said lossless extension data stream is not evaluated and said spectral whitening data are used together with said lossy encoded data stream to decode an output signal having an intermediate quality lower than that of said source signal.

33. Apparatus for decoding a lossless encoded source signal data stream, which data stream was derived from a lossy encoded data stream and a lossless extension data stream which together form a lossless encoded data stream for said source signal, wherein:

said source signal was lossy encoded, said lossy encoding providing said lossy encoded data stream;

spectral whitening data were calculated from quantized coefficients of said lossy encoded data stream and corresponding not yet quantized coefficients were received from said lossy encoding, said spectral whitening data representing a finer quantization of the original coefficients, whereby said calculating was controlled such that the power of the quantized error is essentially constant for all frequencies;

said lossy encoded data were lossy decoded using said spectral whitening data, thereby reconstructing a decoded signal, and side information for controlling a time domain prediction filter was provided;

a difference signal was formed between a correspondingly delayed version of said source signal and said decoded signal;

said difference signal was prediction filtered using filter coefficients that were derived from said side information so as to de-correlate in the time domain the consecutive values of said difference signal;

said de-correlated difference signal was lossless encoded to provide said lossless extension data stream;

said lossless extension data stream was combined with said lossy encoded data stream and said spectral whitening data to form said lossless encoded data stream, said apparatus comprising:

means being adapted for de-multiplexing said lossless encoded source signal data stream to provide said lossless extension data stream and said lossy encoded data stream;

means being adapted for lossy decoding said lossy encoded data stream, using said spectral whitening data, thereby reconstructing a lossy decoded signal and providing said side information for controlling a time domain prediction filter;

means being adapted for decoding said lossless extension data stream so as to provide said de-correlated difference signal;

means being adapted for inversely de-correlation filtering consecutive values of said de-correlated difference signal using filter coefficients that are derived from said side information;

means being adapted for combining said de-correlation filtered difference signal with said lossy decoded signal to reconstruct said source signal.

34. Apparatus according to claim 33, wherein from said side information prediction filter settings data are derived and included in said lossless encoded data stream, or side information prediction filter settings data are taken from said lossless encoded data stream and are used for generating said prediction filtering coefficients.

35. Apparatus according to claim 33, wherein the standard deviation of the prediction residual is used to parameterize said lossless encoding, or to control said lossless decoding, respectively.

36. Apparatus according to claim 33, wherein said lossless extension data stream is not evaluated and said spectral whitening data are used together with said lossy encoded data stream to decode an output signal having an intermediate quality lower than that of said source signal.

* * * * *